United States Patent [19]

Phelps et al.

[11] 4,326,679

[45] Apr. 27, 1982

[54] METHOD AND APPARATUS FOR ROLL CHANGING ON A WINDER DEVICE

[75] Inventors: Richard W. Phelps; Richard S. Tetro, both of Fulton, N.Y.

[73] Assignee: The Black Clawson Company, Fulton, N.Y.

[21] Appl. No.: 165,301

[22] Filed: Jul. 2, 1980

[51] Int. Cl.[3] ..... B65H 19/20

[52] U.S. Cl. ..... 242/56 A

[58] Field of Search ..... 242/56 B, 56 R, 56 A, 242/65, 67.1 R

[56] References Cited

U.S. PATENT DOCUMENTS

| | | | |
|---|---|---|---|
| 3,383,062 | 5/1968 | Meihofer | 242/56 A |
| 3,734,423 | 5/1973 | Katdoka | 242/56 A |
| 3,871,595 | 3/1975 | Smolderer | 242/56 A |
| 4,058,267 | 11/1977 | Schuttler | 242/56 A |

*Primary Examiner*—Edward J. McCarthy

*Attorney, Agent, or Firm*—Biebel, French & Nauman

[57] ABSTRACT

A web cutting blade is secured to an articulated arm which moves the blade towards and away from the web to be severed. The blade is moved to a position adjacent a free span of the web and is held in a stationary position during the severing of the web. A web guide shoe is also mounted on the articulated arm and captures the severed end of the web and directs it around a new core so that it will envelop the core and begin winding on the core so that the roll change can be effected during a continuous web movement. A web defelector member positioned on an opposite side of the web from the cutting blade is also mounted on an articulated arm which can move the deflector towards and away from the web. After the blade has been positioned adjacent the web, the deflector member urges the web into engagement with the blade so that the web will be cut due to the movement of the web across the blade. An enveloper roll is also supported on the side of the web opposite the knife by a further articulated arm which moves the enveloper roll into engagement with the web and urges the web to envelop a portion of the periphery of the new core, after which the deflector member forces the web into engagement with the blade to cause its severance.

11 Claims, 8 Drawing Figures

METHOD AND APPARATUS FOR ROLL CHANGING ON A WINDER DEVICE

CROSS REFERENCE TO RELATED APPLICATION

This application is related to application Ser. No. 165,303 filed on even date herewith.

BACKGROUND OF THE INVENTION

1. Field of the Invention

The present invention relates to a method and apparatus for roll changing on a winding device, and more particularly, to a device for severing a moving web and causing it to envelop a new core so that a winding operation can be carried on continuously.

2. Prior Art

A roll changer is a device used in conjunction with a winder to provide a continuous web winding operation. Roll changers sever the web of material when winding of one roll has been completed, and transfer the new incoming edge around the new core to start the new roll winding thereon. Existing roll changer designs are of two general types. In one, the roll change takes place at web speed. In the other, the roll changing takes place at zero web speed. In the case of zero web speed transfers, continuous web movement is provided by a web storage device known as an accumulator, which device is well known in the art.

Roll changers can additionally be classified as those which utilize adhesive on the core to start the new roll formation, and those which do not. Roll changers which do not utilize adhesive on the core are called enveloper type roll changers.

The introduction of new web materials and increasing operating line speeds has caused existing roll changer designs to produce objectionable defects in the roll changing sequence, and in some cases, the difficulties exceed the capabilities of the machines. For example, poor quality cuts and core starts with wrinkling and fold backs in the web material increase in occurrence as web speeds are increased, when conventional roll changing equipment is utilized. In addition, cutting problems in severing the web are more troublesome with some of the tougher materials now being introduced.

Most existing designs of roll changers utilize a rider roll which rides on the surface of the new core, with the web riding over a portion of the peripheral surface of the roll and then between the nip formed by the rider roll and the new core, and then moves around the periphery of the new core to the cutting station. The cutting station in many of these designs is not sufficiently close to the nip and thus a length of web which is greater than the distance from the cutting station to the nip is produced on cutting and thus insures a fold back of the web on the new core. Also, in these designs the blade is accelerated into the web to cause severance of the web.

Attached behind the knife and moving therewith is usually a brush which contacts the surface of the moving web immediately behind the severed edge and is intended to cause the web to be pressed against the new core. However, the brush follows the path of the knife and departs from the web just prior to the position where the severed web edge enters the nip between the rider roll and the new core. Also, unless the knife and brush are traveling at a substantially greater speed than the web, the brush is not able to travel along the web far enough to reach the severed edge before the edge reaches the nip, and thus the unsupported edge tends to fold back. This problem exists to a greater extent at higher web speeds since it is impractical to accelerate the knife and brush to a sufficiently high speed and then decelerate it, in the available space.

In addition, experience has shown that the problem of fold back is increased by problems of cutting. Cutting problems occur when the material is tough (i.e. resistant to tearing) or elastic, or when web speed increases. Problems caused by tough material are apparent in that the knife assembly must possess enough energy to penetrate the web and sever it. If the energy is too low, the cut does not occur or a uniform cut does not occur so that the edge of the web will not be straight and enter the nip between the rider roll and the new core at the same time across the width of the web.

The problem in cutting elastic material is in trying to maintain a consistent cutting position relative to the distance the edge must travel in order to enter the nip, so that too long a piece of web will not remain. Otherwise, the additional material will fold back on the new core as it enters the nip. The more elastic the web material, the later in the cutting stroke the cut occurs. This is due to the fact that the web behaves like a rubber band, and the knife cannot puncture it until enough resistance force builds up in the web.

The problems due to increase in web speed are not as apparent. The basic problem is the relative velocity between the web and the knife, as mentioned above. If web velocity exceeds knife velocity, the knife cannot penetrate the web; instead the web drags over the knife tip. When knife velocity is greater than web velocity, the blade penetrates the web and causes severance. The amount of speed differential causes the actual cut point to change in the same manner as occurs when a more elastic web is being cut. Any or all of the above problems can result in undesirable fold back along the surface of the core of the new roll, or even prevent severance of webs formed of certain materials.

SUMMARY OF THE INVENTION

The present invention overcomes the above described difficulties and disadvantages associated with the prior art devices, by maintaining a consistent point of web severance and eliminating problems associated with knife speed and location. In this invention, the knife is held stationary during cutting and the web is deflected into the knife which thus maintains a precise cutting position and eliminates the need for high accelerations and decelerations of the knife. Also, the knife is positioned close enough to the nip that the length of the leading edge of web from the knife to the core is less than the peripheral distance on the surface of the core from the knife to the nip which eliminates fold back due to excess material.

These advantages are accomplished through the use of an articulated cutting means which is movable to a web cutting position adjacent one side of a web being wound on a winding machine, and wherein it remains stationary during severing of the web, an articulated web deflector means disposed on an opposite side of the web from the cutting means, for moving the web into engagement with the cutting means for severing the web, means for placing a new rotating core adjacent the cutting means and the web where it is to be severed, and guide means adjacent the cutting means for directing the severed web towards the new core so that it will be wound thereon.

The method includes positioning the new core on which the web is to be wound, in engagement with a free span of the web and rotating the new core; positioning a cutting blade adjacent the web downstream of the new core; urging the web into engagement with the blade to sever the web; guiding the severed web around a portion of the periphery of the new core sufficiently to cause the web to begin winding about the new core; and retracting the cutting blade.

The articulated cutting means preferably includes a cutting blade extending across the width of the web, a pair of laterally spaced blade support arms to which the blade is secured, the support arms being movable between retracted positions wherein the blade is disposed remote from the web and the new core, and a cutting position wherein the blade is disposed adjacent a free running span of the web and a web guide shoe secured to the support arms adjacent the blade and positionable adjacent the new core when the arms are disposed in the cutting position, for directing a severed edge of the web toward the new core so as to cause it to wind thereabout.

The deflector means preferably includes a deflector member having a long straight edge extending the width of the web for engaging the web, and a pair of laterally spaced deflector member support arms to which the deflector member is secured and which are movable between a retracted position remote from the web and a web cutting position adjacent the cutting means in engagement with the web so as the deflector member approaches the cutting position, it moves the web into the blade to sever the web.

Additionally, the roll changing device preferably includes an enveloper roll, and means rotatably mounting the enveloper roll on the side of the web opposite the blade, for moving the enveloper roll between a retracted position disengaged from the web and an active position wherein the enveloper roll causes the web to envelop a portion of the periphery of the new core upstream from the blade.

Also, a pressure roll preferably extends across the width of the web, a pair of pressure roll support arms rotatably support the pressure roll for pivotal movement toward and away from the roll of web being wound, and means engaging the pressure roll support arms are provided for urging the pressure roll into engagement with the roll of web material.

In its preferred form, a first pair of slide members are mounted on a frame above the winding machine at spaced locations transverse to the web for sliding movement toward and away from the web and support the blade support arms and the pressure roll support arms for movement therewith. A second pair of slide members are mounted on the frame in spaced locations transverse to the web for sliding movement toward and away from the web and support the deflector member support arms for movement therewith. In addition, a first drive means is provided for simultaneously moving the first pair of slide members towards and away from the web, and a second drive means is provided for simultaneously moving the second pair of slide members towards and away from the web.

In the method of the present invention, the step of guiding the severed web around the new core preferably includes positioning a curved guide shoe adjacent the cutting blade and the new core so that the edge of the severed web winds around the periphery of the new core without folding back upon itself. The step of urging the web into the blade preferably includes engaging the web with the deflector member across the width of the web on the opposite side of the web from the blade, and moving the deflector member into the blade to cause the web to be severed thereby. Also prior to the step of urging the web into the blade, it is preferred that the web be engaged by an enveloper roll which causes it to envelop a portion of the periphery of the new core.

DETAILED DESCRIPTION OF THE PREFERRED EMBODIMENT

Figure 1:
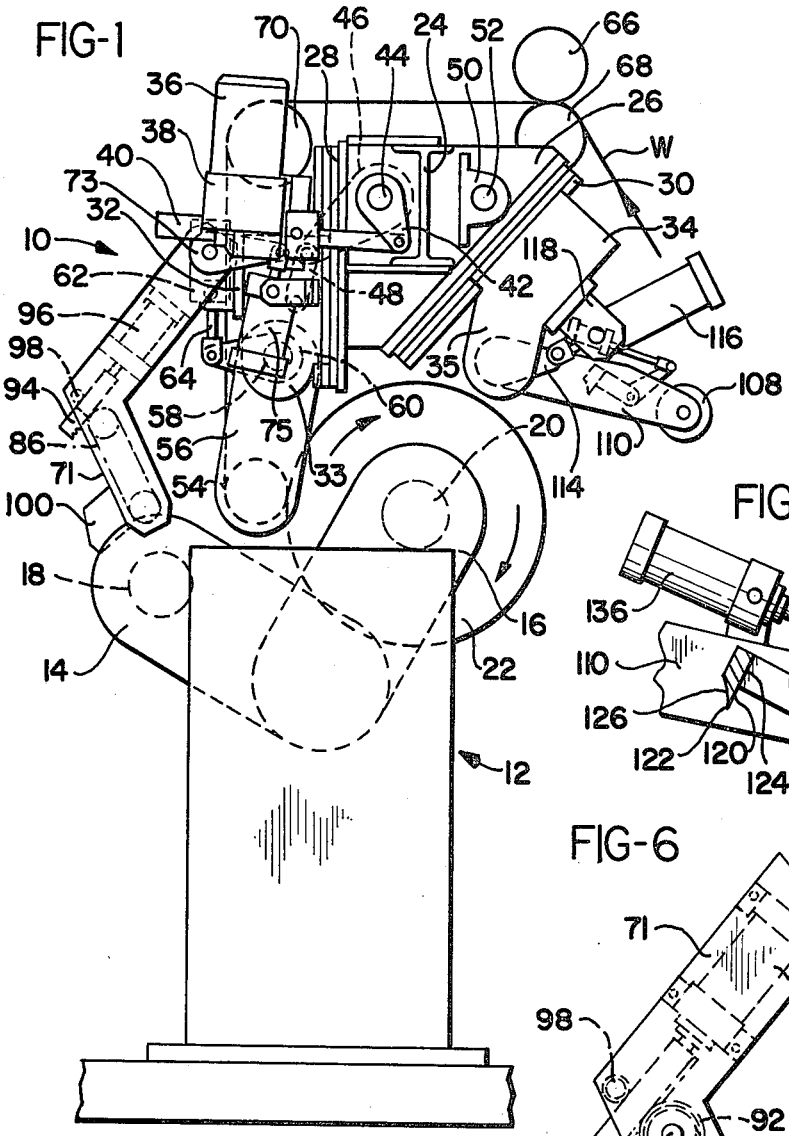
FIG. 1 is a side elevational view of a winding machine with the preferred embodiment of roll changer of the present invention disposed above it in the retracted position during completion of winding of a roll of web material.
Figure 5:
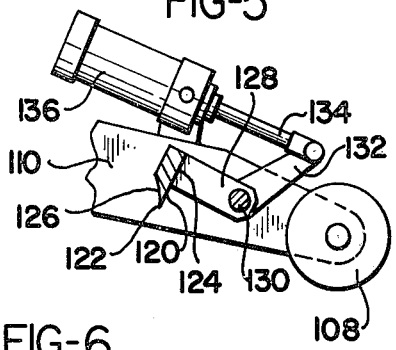
FIG. 5 is an enlarged partial view of the web deflector means of the preferred embodiment.

Referring to FIG. 1, the roll changing device 10 is illustrated as being disposed above a turret indexing winder 12 of conventional construction with two pairs of separately rotatable arms 14 and 16 which are each capable of rotatably supporting the respective cores 18 and 20 upon which a roll of web material, such as roll 22, can be wound. Each of the cores 18 and 20 can be rotatably driven by a drive means (not shown) to cause the web material to be wound thereon.

It is to be noted that since the views are side views only, substantially identical apparatus in both the roll changing device 10 and winding device 12 are positioned on the opposite sides of the devices with various members extending across the width of the web W, except as specifically noted below.

The roll changer 10 is supported on a beam frame 24 above the winding machine 12, and a base member 26 is secured to the frame 24 on each side of the web W. Each base member 26 provides a vertically disposed slideway 28 and an angular slide way 30 upon which are respectively supported for sliding movement towards and away from the winding machine 12, a cutting means support slide member 32 and a web deflector means support slide member 34. Slide members 32 and 34 each provide a pair of spaced, parallel plates (only the outermost of each being shown) 33 and 35, respectively.

The slide members on the side of the machine as shown are each driven toward and away from the winding machine 12 by a reversible motor 36 through a speed reducing gear box 38 which, through a worm gear (not shown), engages the axially threaded rod 40 which is pivotally connected at its inner end to lever arm 42 secured to a shaft 44 which extends across the width of the web W and rotates back and forth in response to axial movement of rod 40.

A pair of further lever arms 46 (only one of which is shown) on opposite sides of the web and also secured on shaft 44, and each has a link 48 pivotally attached thereto at one end and at its opposite end to the cutting means support slide member 32 which causes movement of the slide member along the slide way 28 upon rotation of shaft 44. A similar drive means is provided to drive the web deflector means support slide member 34 toward and away from the winding machine 12, but it has been removed from the drawings for the sake of clarity. It is mounted on the bracket 50 which supports a rotatable shaft 52 extending across the width of the web and operating the same as shaft 44 and its associated levers.

A pressure roll 54, extending across the width of the roll 22, is supported by a pair of pivotal arms 56, one on each side of the web W. The pivotal arms 56 are in turn pivotally mounted in respective slide members 32, secured to a rod 58 which extends between and is rotatably supported by plates 33. A lever arm 60 is also secured to the rod 58 which in turn is pivoted by double acting hydraulic cylinder motor 62 through the pivotally connected piston rod 64, so that as the cylinder motor 62 extends the piston 64, pressure roll 54 will be directed towards the surface of roll 22. The pressure applied by the hydraulic cylinder motor 62 is preestablished to maintain the proper pressure at the nip between pressure roll 54 and the roll of web material 22, so that the web is laid down on the roll at a predetermined pressure as the roll expands. As the roll diameter increases, the hydraulic cylinder motor 62 retracts the piston rod 64 which in turn moves the pressure roll outwardly towards the left, as shown in FIG. 1.

A pair of web support rollers 66 and 68 guide the web through the roll changer 10 onto a further roller 70 about which the web makes approximately a right angle bend and extends down to the pressure roller 54 around its periphery and onto the surface of the roll 22.

Figure 2:
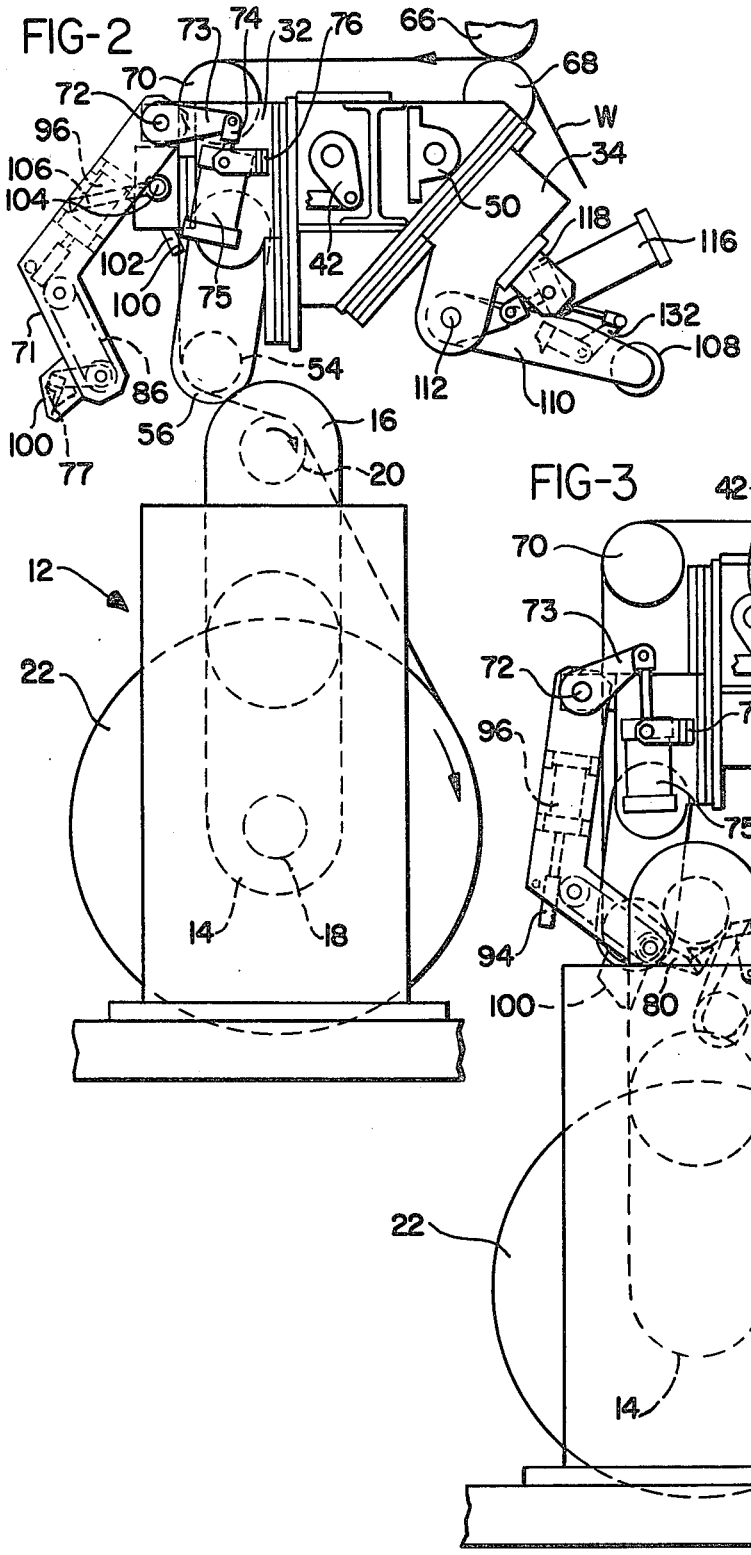
FIG. 2 is a view similar to FIG. 1 with an almost completed roll on the winder and a new core brought into position in engagement with the web.

As best seen in FIG. 2, with additional pieces of the roll changer being removed for clarity, an articulated cutting means is shown supported by slide member 32, and a further articulated deflector means is shown supported by the slide member 34. The articulated cutting means includes a support arm 71 which is pivotally mounted at one end to the slide member 32 through a rod 72. Rod 72 has a lever arm 73 secured thereto which has its opposite end pivotally mounted to a piston rod 74 extending from a double acting hydraulic cylinder motor 75 which in turn is pivotally mounted in a bracket 76 secured to slide member 32. As hydraulic cylinder motor 75 extends the piston 74, it in turn rotates lever arm 73 which, through rod 72, rotates the support arm 71 towards the winding machine 12. Rod 72 extends across the width of web W and has its opposite end supported in a slide member, such as 32, on the opposite side of the roll changer, and to which is secured an identical support arm 71 of mirror image to that shown in FIG. 2.

Extending between the pair of support arms 71 at the lowermost end thereof is a cutting blade 77. Blade 77 extends across the entire width of the web and is supported at least at each end thereof by brackets 78 which are secured to lever arms 80, which in turn are pivotally mounted to a shaft 82 extending across the width of the web W. Drivingly secured to shaft 82 is a sprocket 84 engaged by an endless chain 86 which also encircles a further sprocket 88. Sprocket 88 is, in turn, supported for rotation on shaft 90 which also supports a pinion gear 92 which, in turn, is engaged by a rack 94. Rack 94, in turn, is supported on the piston rod of a double acting hydraulic cylinder motor 96, and is provided with a backing roller 98 to hold the rack in engagement with the pinion 92 as the rack is extended or retracted. Thus, it can be seen that when the rack 94 is extended, it results in the blade 77 being rotated counterclockwise as shown.

Also supported on brackets 78 is a web guide shoe 99 which extends across the width of the web and has an arcuate surface slightly larger than the diameter of the new core 18 so that the surface of the core and the arcuate surface of the shoe are parallel and define a narrow channel through which the new leading edge of the severed web will be directed so as to begin to wrap around the core. The arcuate surface of the guide shoe 99 begins adjacent the cutting edge of blade 77 so that the leading edge of web material is immediately guided towards the new core and does not have the opportunity to fold back due to being unsupported.

Figure 6:
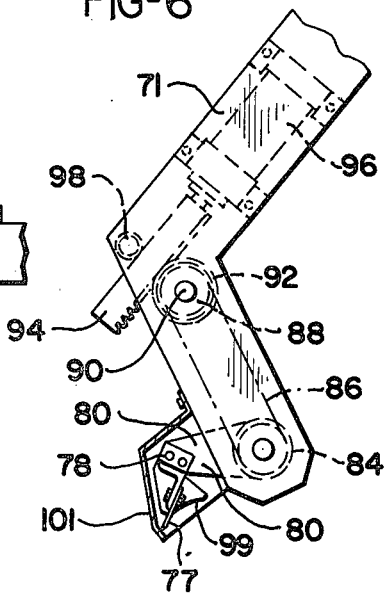
FIG. 6 is an enlarged partial view of the cutting means and guide means of the present invention.
Figure 7:
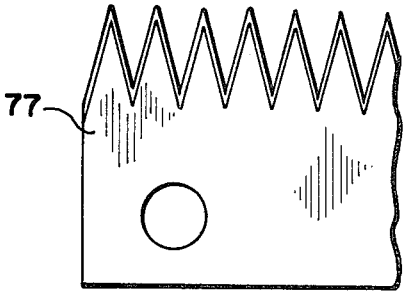
FIG. 7 is a partial view of the saw tooth blade of the preferred embodiment.

Both blade 77 and guide shoe 99 are positioned within a housing 101 when in the retracted position. Housing 101 is of sheet metal construction with a cross section as shown in FIG. 6, and extends across the width of the machine to cover the entire blade and guide shoe. At each end it is secured to support arms 71, as by bolts or the like.

Also illustrated in FIG. 2 is a web slitter consisting of a blade 100 supported on a vertically extending bar 102 which is secured to a shaft 104 for pivotal movement therewith. On one end of the shaft 104 is a handle 106 for rotating the shaft to move the blade 100 into or out of engagement with the web W. The shaft 104 extends horizontally across the roll changer and is mounted on each end to the pair of slide members 32. A plurality of slitter blades 100 and their support bars 102 can be positioned along the shaft in order to slit the web longitudinally at any desired widths across its complete width. It is to be noted that since the slides 32 are disposed in the vertical position, movement thereof will not affect the contact of the blades 100 with the web W as the slides are moved towards and away from the winding machine 12.

Figure 3:
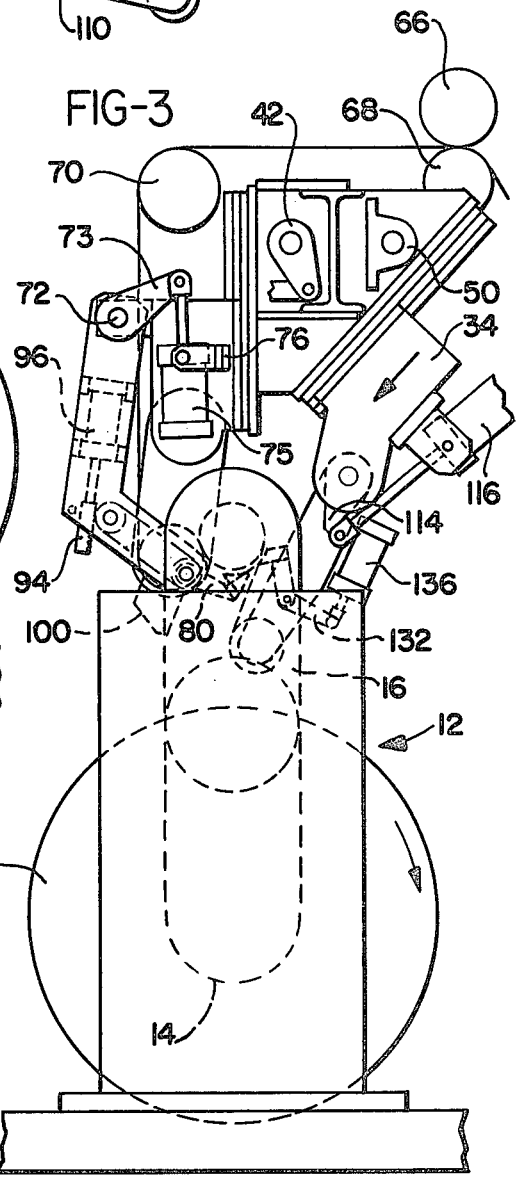
FIG. 3 is a view similar to FIG. 2 with the cutting blade, web deflector means and enveloper roll in the cutting positions.

Since the roll changing device 10 of the present invention is being described with an enveloper type of method of transferring the severed edge of the web to a new core, an enveloper roll 108 is shown supported by a pair of spaced envelope roll support arms 110 (only one shown) which are disposed on opposite sides of the web and supported for pivotal movement at their upper edge portions on a shaft 112 which, in turn, is pivotally mounted in the pair of slide members 34 supported on opposite sides of the roll changer. A lever arm 114 is secured to shaft 112 and has its outer end pivotally connected to the piston of double acting hydraulic cylinder motor 116 which, in turn, is pivotally mounted to bracket 118 secured to one slide member 34. As hydraulic cylinder motor 116 extends the piston and rotates lever arm 114, the enveloper roll 108 is moved into engagement with the surface of the web, forcing it to wrap around a substantial portion of the periphery of the new core 18, as seen in FIG. 3. In addition, the slide member 34 is moved down the guide way 30 to position the enveloper roll properly relative to the new core.

Figure 8:
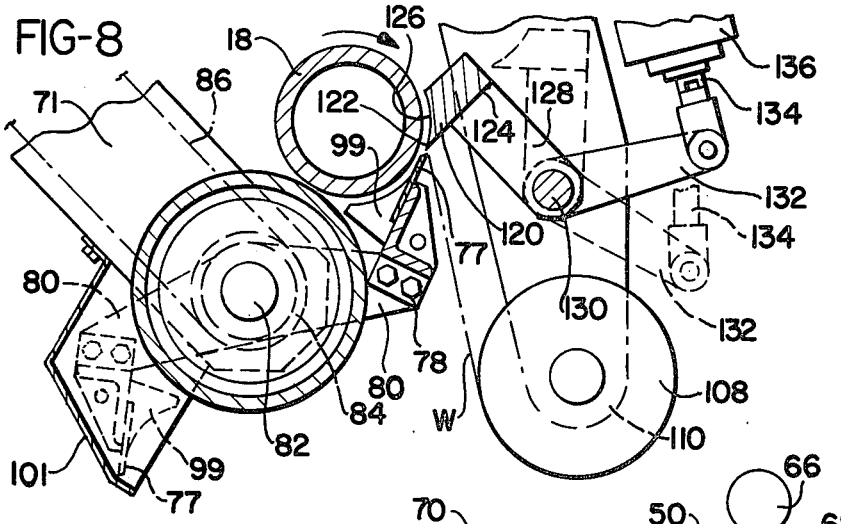
FIG. 8 is a partial enlarged cross sectional view of the cutting means, guide means and web deflector means positioned about a new core immediately prior to severing of the web.
Figure 4:
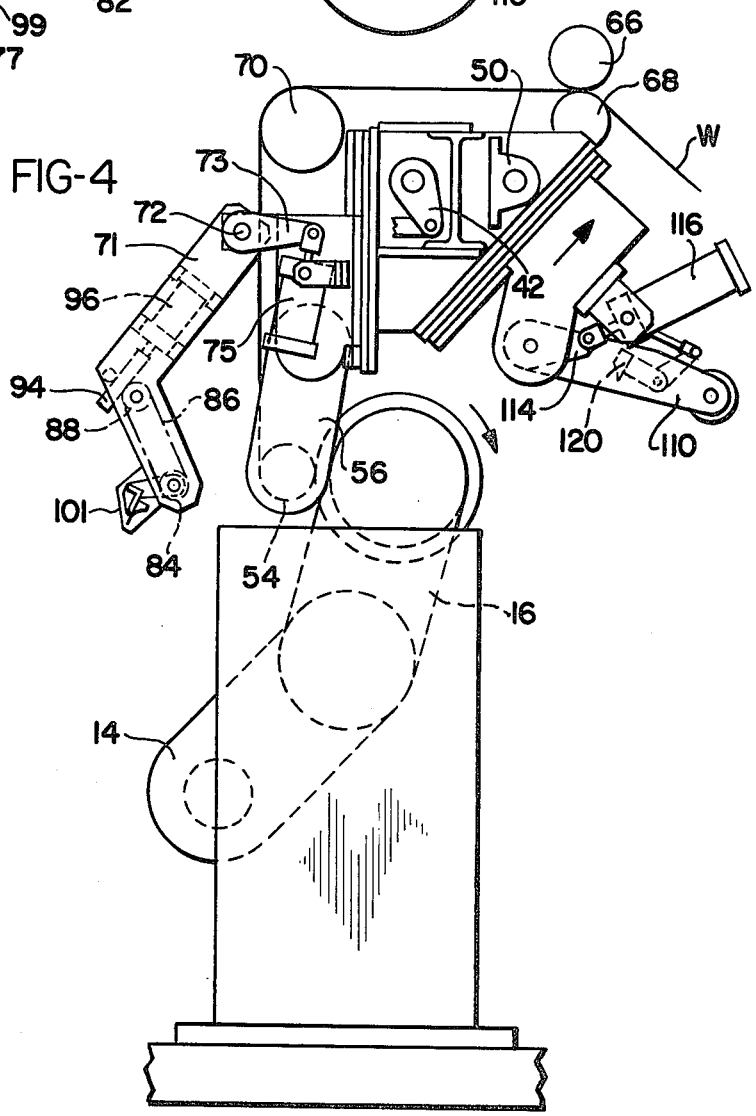
FIG. 4 is a view similar to FIG. 3 after the web has been severed and transferred to the new core and with the blade, web deflector means and enveloper roll in the retracted positions.

Also supported on the enveloper support arms 110 is the web deflection means. The web deflection means is basically comprised of a long bar 120 which extends across the width of the web and provides a straight edge portion 122 formed at the intersection of the straight side 124 and an arcuate side 126 which has a radius equal to the distance from the center of the new core 18 when the bar 120 is positioned adjacent the new core, as shown in FIG. 8.

The bar 120 is supported on a pivoting lever arm 128 which is secured to a shaft 130 extending between the support arms 110 on opposite sides of the web. A lever arm 132 is secured at one end to shaft 130 for rotation therewith and has its opposite end pivotally secured to the piston 134 of hydraulic cylinder motor 136. With the piston rod 134 in the extended position, the bar 120 is in the retracted position, and when the piston rod is retracted by the hydraulic cylinder motor 136, the bar 120 will engage the web and force it into the path of blade 77, as discussed more fully below.

Referring to the manner of operation of the preferred embodiment of the roll changer 10 of the present invention, prior to the roll changing sequence and during the winding of the roll 22 of web, as shown in FIG. 1, the arm 16 is sequentially indexed clockwise as the size of the roll increases, as shown progressively through FIGS. 1 and 2, so that eventually the roll is disposed in the lowermost position. During this time, the arms 14 are rotated clockwise, and a new core 18 is positioned thereon in a conventional manner. As the roll 22 moves downwardly, it eventually becomes disengaged from the pressure roller 54, which is then moved to the retracted position as shown in FIG. 2, by upward movement of the slide members 32. The arms 14 are then indexed clockwise so that the new core 18 is positioned in the uppermost position in engagement with the moving web and is rotated about its central axis so that its surface speed matches that of the web speed.

The pressure roller 54 is then moved downwardly by movement of slide members 32 to the position shown in FIG. 3 where it is in contact with the surface of the new core, preferably below the center of the new core. Slide 34 is then extended to its lowermost position, and enveloper roll 108 is rotated into engagement with the web and forces the web to envelop more of the new core 18, as shown in FIG. 3.

Support arms 71 are then rotated counterclockwise through the action of hydraulic cylinder motor 75, to bring the blade 77 to a position adjacent the lower portion of new core 18. The blade is then swung to a position immediately adjacent the surface of the new core and adjacent the moving web, by action of hydraulic cylinder motor 96. This also positions the guide shoe 99 immediately adjacent the surface of the new core 18, as best seen in FIG. 8.

At the desired moment for making the cut, hydraulic cylinder motor 136 retracts piston 134, which in turn moves the bar 120 into engagement with the web and moves the web into engagement with the cutting blade 77 which severs the web. The new leading edge portion of the web will then pass along the guide shoe 99 to the nip between pressure roller 54 and new core 18 where it will then become overlaid by the subsequent portion of the web and begin winding about the new core.

After the cut has been made, the blade is retracted into the shield, and the support arms 71 are rotated clockwise to remove the cutting blade from the area of the web and new roll being wound. Likewise, the enveloper roll is retracted, the deflector member is retracted, and the slide 34 is moved upwardly to a position where it will not interfere with the indexing of the arms 14 during winding of the core 18. The slide member 32 is maintained in its lower position in order to maintain the pressure roller 54 in engagement with the surface of the web being wound on the new core 18. As the web builds up on the new core, the pressure roller will move outwardly under the predetermined pressure on the nip between the pressure roller and the web being wound on core 18, as described above. Since it is preferable to reduce as much as possible the effect of the weight of the pressure roll on the new roll of web being wound in order to control the pressure more accurately, in the preferred embodiment the pressure roll is only moved outwardly a slight amount and the increasing diameter of the roll being wound is taken care of by continuously indexing the rotatable arms 14 and 16 of the indexing winder 12.

Thus, it can be seen that by positioning the blade in a stationary location adjacent the new core, the point of severance of the web relative to the nip between the pressure roller and the new core is fixed at a constant distance since the web will always be severed at the knife blade even though some movement of the web may occur due to stretching of the material from which the web is formed. The distance will remain the same to the nip after the web has been severed. The point of severance is therefore not dependent upon the blade velocity, nor is the relative velocity between the blade and web speed critical, since it is the velocity of the web and the web tension alone which cause it to be severed upon engagement with the blade.

Although the foregoing illustrates the preferred embodiment and method of the present invention, other variations are possible. All such variations as would be seen obvious to one skilled in this art are intended to be included within the scope of the invention as defined by the following claims.

What is claimed is:

1. A roll changer for use on a winding machine, comprising:

an articulated cutting means movable to a web cutting position adjacent but out of engagement with one side of a web being wound on said machine and wherein it remains stationary during severing of the web;

an articulated web deflector means disposed on the opposite side of said web from said cutting means, for moving said web into engagement with said cutting means when the latter is in said web cutting position to sever said web;

means for placing a new rotating core adjacent said web when it is to be severed; and guide means adjacent said cutting means for directing the leading end of said severed web towards said new core so that it will be wound thereon.

2. A roll changer as defined in claim 1 wherein said cutting means includes:

a cutting blade extending across the width of said web;

a pair of laterally spaced blade support arms to which said blade is secured, said support arms being movable between a retracted position wherein said blade is disposed remote from said web and a cutting position wherein said blade is disposed adjacent but out of engagement with a free running span of said web; and said guide means includes a web guide shoe secured to said support arms adjacent said blade and positionable adjacent said new core when said arms are disposed in said cutting position to direct the leading end of said severed web toward said new core so as to cause it to wind thereabout.

3. A roll changer as defined in claim 1 wherein said deflector means includes:

a deflector member having a long straight edge extending the width of said web for engaging said web;

a pair of laterally spaced deflector member support arms to which said deflector member is secured and which are movable between a retracted position remote from said web and a web cutting position adjacent said cutting means in engagement with said web so that as said deflector member approaches said cutting position, it moves said web into said blade to cause said web to be severed thereby.

4. A roll changer as defined in claim 1 or 2 including:

an enveloper roll; and means rotatably mounting said enveloper roll on the side of said web opposite said blade for moving said enveloper roll between a retracted position disengaged from said web and an active position wherein said enveloper roll causes said web to envelop a portion of the periphery of said new core upstream of said blade.

5. A roll changer as defined in claim 1, including:

a pressure roll extending transverse to and across the width of said web;

a pair of pressure roll support arms rotatably supporting said pressure roll for pivotal movement toward and away from a roll of web being wound on said winding machine, and means engaging said pressure roll support arms for urging said pressure roll into engagement with said roll of web.

6. A roll changer as defined in claim 5 including:

a frame disposed above said winding machine;

a first pair of slide members mounted on said frame in spaced locations transverse of said web for sliding movement toward and away from said web and supporting said blade support arms and said pressure roll support arms, for movement therewith;

a second pair of slide members mounted on said frame in spaced locations transverse of said web for sliding movement toward and away from said web and supporting said deflector member support arms for movement therewith;

first drive means for simultaneously moving said first pair of slide members towards and away from said web; and second drive means for simultaneously moving said second pair of slide members towards and away from said web.

7. A method of severing a web being wound on a winding machine, including the steps of:

positioning the new core upon which said web is to be wound in engagement with a free span of said web and rotating said new core;

positioning a cutting blade in a stationary location adjacent to but out of engagement with said web downstream of said new core;

urging said web into engagement with said blade to cause said web to be severed thereby;

guiding said severed web around a portion of the periphery of said new core sufficiently to cause said web to begin winding about said new core; and retracting said cutting blade.

8. A method as defined in claim 7 wherein said step of guiding said severed web around said new core includes positioning a curved guide shoe adjacent said blade and said new core so that the edge of said severed web will be directed around the periphery of said new core without folding back upon itself.

9. A method as defined in claim 8 wherein said step of urging said web into said blade includes engaging said web with a deflector member across the width of said web on an opposite side thereof from said blade and moving said deflector member toward said blade to cause said web to be severed thereby.

10. A method as defined in claim 9 including prior to the step of urging said web into said blade, the step of engaging said web with an enveloper roll to cause said web to envelop a portion of the periphery of said new core.

11. A roll changer as defined in claim 1 wherein said cutting means is disposed on the new core side of the web.

* * * * *